United States Patent [19]

Flanders et al.

[11] Patent Number: 4,485,512

[45] Date of Patent: Dec. 4, 1984

[54] MACHINES FOR LASTING HEEL SEAT PORTIONS OF SHOES

[75] Inventors: James R. Flanders, Blaby; Robert A. Newton, Cosby; William H. Berrill, Leicester, all of England

[73] Assignee: USM Corporation, Farmington, Conn.

[21] Appl. No.: 412,846

[22] Filed: Aug. 30, 1982

[30] Foreign Application Priority Data

Aug. 28, 1981 [GB] United Kingdom ..... 8126399

[51] Int. Cl.[3] ..... A43D 21/00

[52] U.S. Cl. ..... 12/12.5; 12/14.4; 12/54.3

[58] Field of Search ..... 12/12.5, 12.3, 14.4, 12/54.3

[56] References Cited

U.S. PATENT DOCUMENTS

| | | | |
|---|---|---|---|
| 4,322,863 | 4/1982 | Giebel | 12/12.5 |
| 4,360,938 | 11/1982 | Murphy et al. | 12/12.5 |
| 4,400,839 | 8/1983 | Hartshorn et al. | 12/12.5 |

FOREIGN PATENT DOCUMENTS

| | | | |
|---|---|---|---|
| 2135951 | 2/1973 | Fed. Rep. of Germany | 12/12.5 |

*Primary Examiner*—Werner H. Schroeder
*Assistant Examiner*—Steven N. Meyers
*Attorney, Agent, or Firm*—Donald N. Halgren

[57] ABSTRACT

In a heel seat lasting machine (or combined side and seat lasting machine) the shoe is located lengthwise and heightwise in relation to the heel seat lasting instrumentalities (18) by first locating it lengthwise by the heel band (16), retracting it through a predetermined distance to separate it from the heel band, locating it heightwise against a holddown (20), and returning it to its lengthwise location, moving the holddown therewith during the return movement.

12 Claims, 7 Drawing Figures

10
42
44
50
66
70
46
48
68
52
54
64
56
62
78
58
60
42
40
74
76
36
38

MACHINES FOR LASTING HEEL SEAT PORTIONS OF SHOES

FIELD OF THE INVENTION

This invention is concerned with machines for lasting heel seat portions of shoes, including machines which last only such heel seat portions and combined machines for lasting both the heel seat and side portions of shoes. The term "shoe" where used herein is used generically as indicating articles of outer footwear generally, and including such articles in the course of their manufacture.

PRIOR ART

Machines for lasting heel seat portions of shoes conventionally comprise a shoe support, for supporting a shoe comprising an upper and an insole carried on a last, a support head on which are mounted a heel band, a holddown and heel seat lasting instrumentalities comprising two wiper plates, means for effecting relative movement of approach between the shoe support and the support head to bring them to an operative relationship determined by engagement of the heed end of a shoe supported by the shoe support with the heel band, the shoe thus being located in a lengthwise direction relative to the heel seat lasting instrumentalities and to the holddown, and means for effecting relative heightwise movement between the shoe support and the holddown, whereby to locate the heel seat region of the shoe bottom in a heightwise direction relative to the plane of the wiper plates of said instrumentalities.

In using such a machine, if the heel end of the shoe remains pressed against the heel band during the heightwise movement between the shoe support and holddown, there will be a tendency for the relative positions of the upper and the last to be altered. This will be especially the case where only toe end portions of the shoe have previously been lasted.

To combat this problem, in one commercially available machine the relative movement of approach between the shoe support and the support head takes place simultaneously with the relative heightwise movement between the shoe support and the holddown so that, provided the machine is correctly set up, the risk of the heel band dislodging the upper on its last is minimized. However, conventionally the shoe support comprises a last pin on which the last is placed, the pin being accommodated in a hole drilled in the cone of the last. Whereas the drilling of these holes is intended to be standard, there is in practice a significant difference between successive lasts in the location of the hole. Consequently, for the machine in question to be effectively used, a setting up operation should be performed in respect of each last introduced to the machine. This is clearly time-consuming and thus unacceptable.

In U.S. Pat. No. 3,409,921 is described a machine in which a carriage for the heel band, wipers and holddown is moved towards a shoe supported on a last pin to a limit determined by a sensing finger, which engages the cone of the last, beyond the top line of the upper. The shoe is then located heightwise by the holddown, and thereafter the heel band is then advanced relative to its carriage to embrace the heel end of the shoe. It will thus be appreciated that, in this machine, the sensing finger is located relative to the heel seat lasting instrumentalities. In said machine, however, a problem arises in that, especially in the case of a heel seat lasting machine using tacks, it is important that the wiper plates are properly located in relation to the heel seat region of the shoe, and thus it is desirable that the lengthwise location of the shoe be achieved from the feather line region thereof rather than from beyond the top line region, since the backseam region of lasts may vary according to shoe style and thus sensing from beyond the top line may require re-setting of the position of the sensing finger lengthwise relative to the wiper plates. Furthermore, the orientation of the hole which receives the last pin may affect the relationship between the shoe and the sensing finger.

It is the object of the present invention to provide an improved machine for lasting heel seat portions of shoes in which the heel band is utilized for the lengthwise location of the shoe, but in the operation of which the risk of the upper being thereby dislodged upon its last is minimized.

BRIEF SUMMARY OF THE INVENTION

A machine having means which is provided, operable when the shoe support and shoe head are in their operative relationship, for effecting relative movement of separation between the shoe support and heel band through a predetermined distance to disengage the heel end of the shoe from the heel band, the relative heightwise movement between the shoe support and the holddown taking place while the heel end of the shoe and heel band are thus disengaged, whereafter return movement is caused to take place between the shoe support and the heel band to return the heel end of the shoe into engagement with the heel band.

It will thus be appreciated that, in using said machine, the shoe, having first been located lengthwise, can be located heightwise while out of engagement with the heel band, so that the latter cannot have a dislodging effect on the upper during the heightwise location of the shoe, while at the same time the heel band is used for the lengthwise location of the shoe, so that the heel end of the shoe is properly located in relation to the heel seat lasting instrumentalities.

The means for effecting relative movement of separation between the shoe support and the heel band conveniently comprises a link arrangement the effective length of which can be varied, whereby to cause relative movement of separation to take place as aforesaid, said link arrangement being locked in a desired condition during the relative movement of approach between the shoe support and the support head. Conveniently, the link arrangement is constituted by a toggle arrangement. It will be appreciated that, in this way, the initial lengthwise location of the shoe by engagement with the heel band remains unaffected by the means for effecting relative movement of separation, but at the same time, when released from being locked, allows the relative movement of separation to take place through a predetermined distance By separating the shoe support and the heel band through a predetermined distance, furthermore, the heightwise location can take place in a controlled manner so that, upon the return movement being effective between the shoe support and the support head, the heightwise location can be maintained in relation to the heel band.

The aforementioned link arrangement may be located between the heel band and the support head. Alternatively, where the means for effecting relative movement of approach between the shoe support and the support head comprises a piston-and-cylinder arrangement, in one preferred embodiment the link arrangement may form part of a support linkage for said piston-and-cylinder arrangement, or alternatively said piston-and-cylinder arrangement may be arranged to act through the link arrangement, in either case variation of the effective length of the link arrangement being effective through the piston-and-cylinder arrangement to cause relative movement of separation to take place as aforesaid. Furthermore, where a piston-and-cylinder arrangement is incorporated as aforesaid, preferably also locking means is associated therewith to lock said arrangement in the condition to which it has moved when the heel end of the shoe has been engaged by the heel band, such locking taking place prior to the effective length of the link arrangement being varied. In the case of a pneumatically operated piston-and-cylinder arrangement, furthermore, the locking means conveniently comprises a clamp arrangement which co-operates with a rod associated with said arrangement.

In order to avoid friction between the holddown and the heel seat region of the shoe during the return movement between the shoe support and the heel band, preferably the holddown is mounted on the support head for limited movement, in a direction extending lengthwise of the shoe bottom, relative to the heel band, resilient means being provided for urging the holddown away from the heel band prior to engagement thereof with the heel seat region of the shoe as aforesaid. Thus, where, as in one preferred embodiment, the piston-and-cylinder arrangement is operatively connected with the shoe support, during the return movement of the shoe support towards the heel band, the holddown is moved with the shoe against the influence of the resilient means and thus remains in fixed engagement with the heel seat region thereof. In this way, the heightwise location of the shoe can be maintained during the return movement.

BRIEF DESCRIPTION OF THE DRAWINGS

There now follows a detailed description, to be read with reference to the accompanying drawings, of one machine in accordance with the invention, which machine has been selected for description merely by way of exemplification of the invention and not by way of limitation thereof.

In the accompanying drawings.

BRIEF DESCRIPTION OF THE PREFERRED EMBODIMENT

Figure 1:
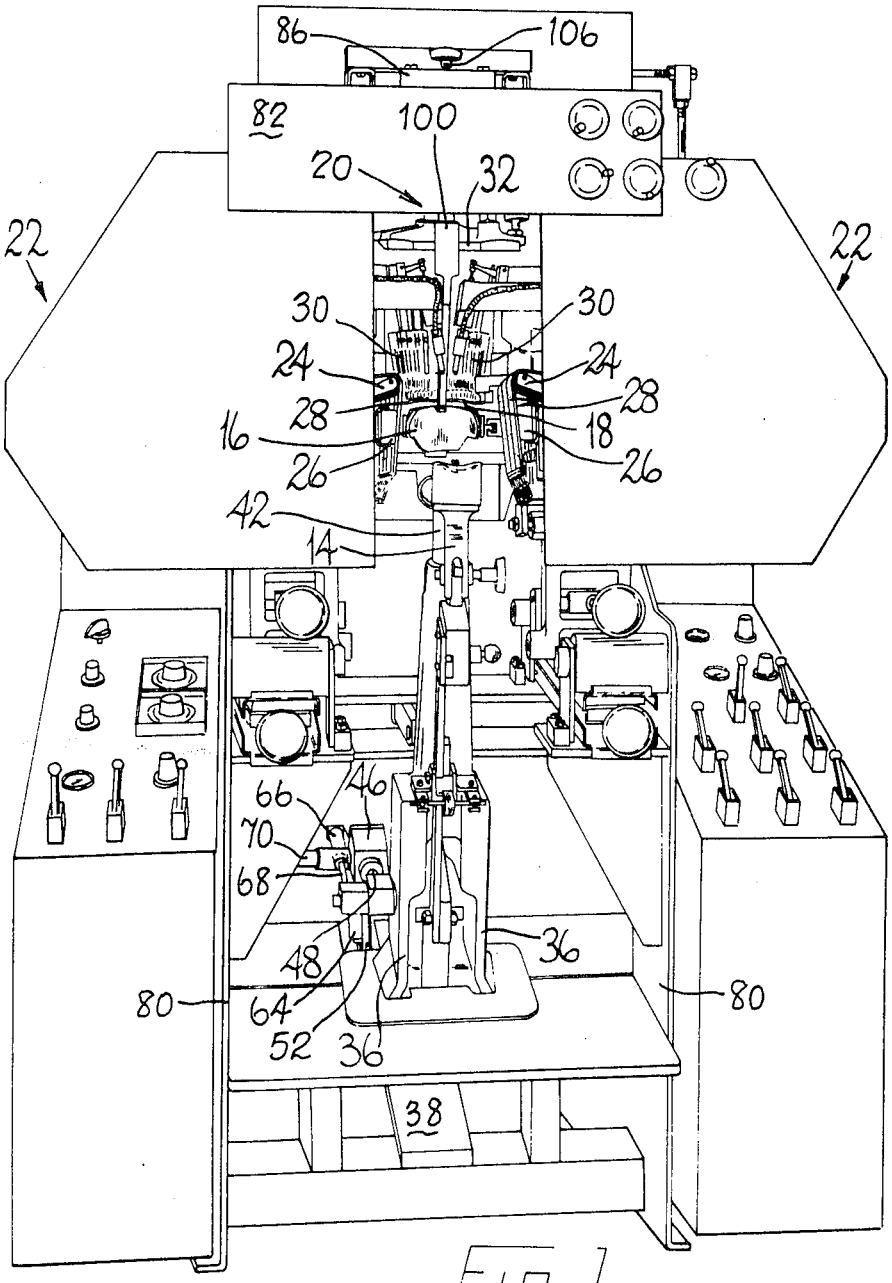
FIG. 1 is a front perspective view of the machine in accordance with the invention.

The machine now to be described is a machine for use in the combined lasting of heel seat and side portions of shoes and comprises a shoe support generally designated 10, including a last pin 12 on which a shoe can be supported, bottom uppermost, and a toe rest 14, a heel band 16, heel seat lasting instrumentalities including two wiper plates 18, a holddown generally designated 20 and side lasting instrumentalities generally designated 22, said instrumentalities comprising a plurality of fingers 24, a plurality of clamp pads 26 and lasting strap elements 28 extending over said fingers 24 and pads 26. The side lasting instrumentalities 22 are generally similar to those described in our co-pending patent application Ser. No. 8035768. The wiper plates 18 form part of heel seat lasting instrumentalities which also include fastener-inserting devices generally designated 30 actuated by a pneumatically operated strike plate 32. The heel seat lasting instrumentalities and the heel band 16 are mounted on a support head (forming part of the main frame of the machine) and are generally similar to those of the machine described in our co-pending patent application Ser. No. 8020133.

Figure 2:
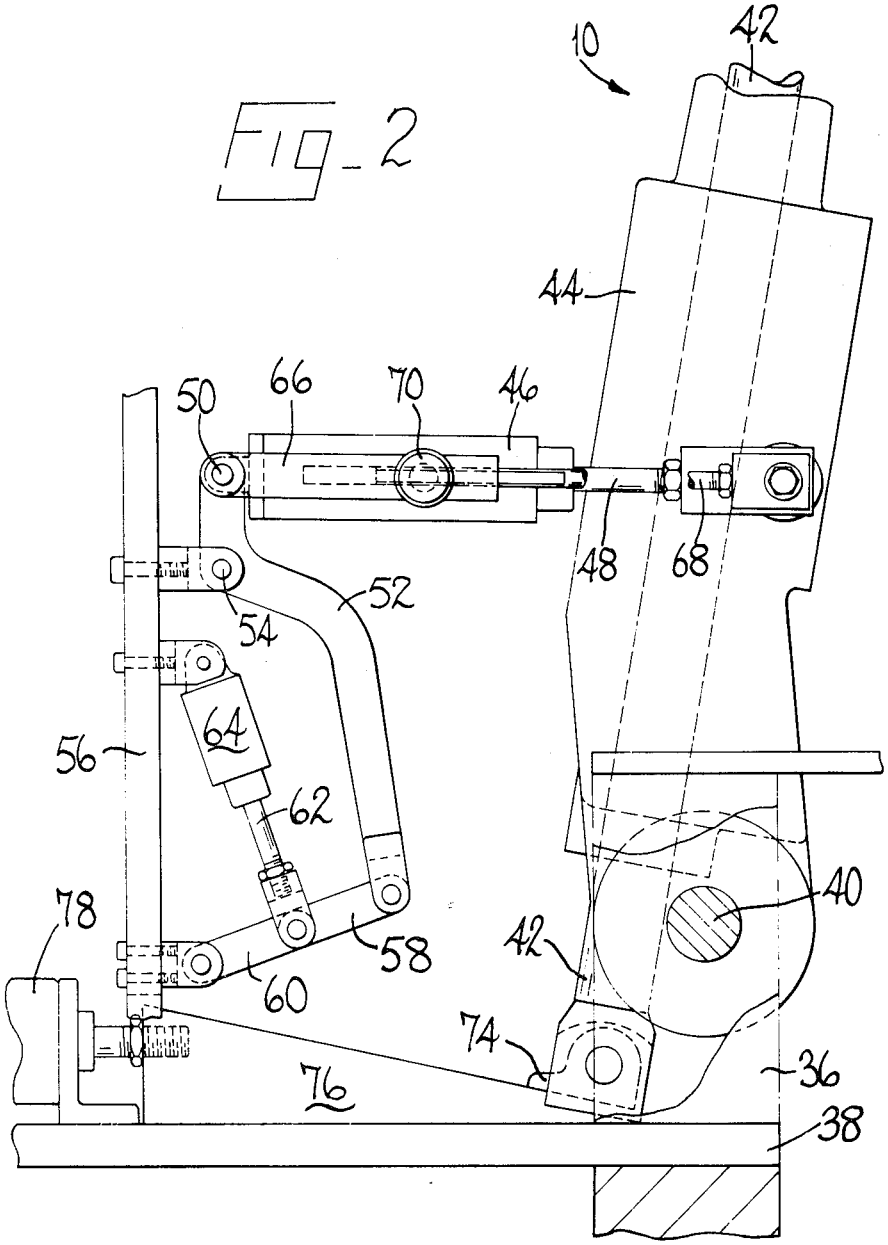
FIG. 2 is a fragmentary side view, partly in section, showing details of a toggle arrangement forming part of a support linkage for a shoe support of the machine shown in FIG. 1.
Figure 3:
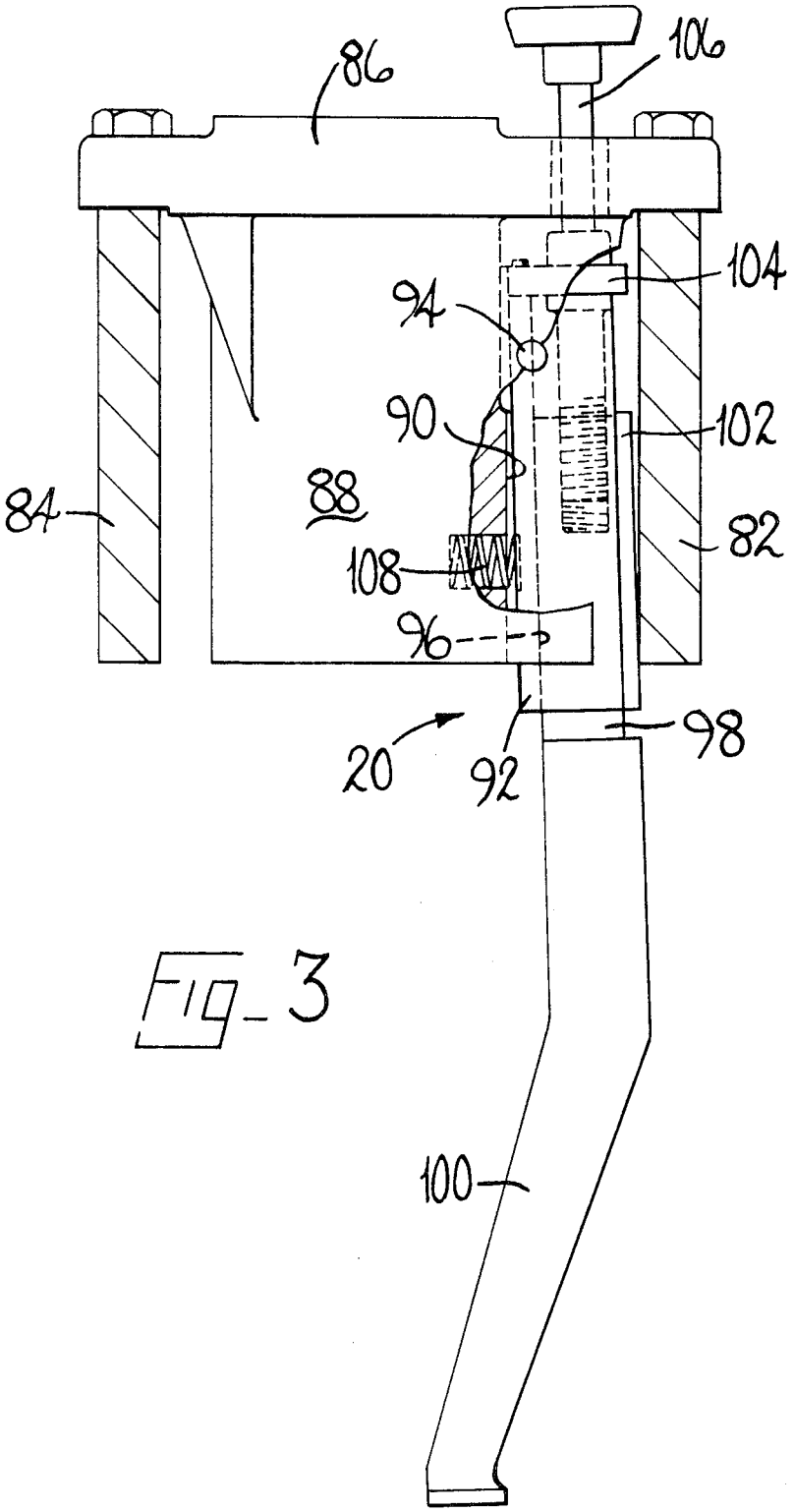
FIG. 3 is a fragmentary side view, partly in section, showing details of a holddown of said machine.

The shoe support 10 is mounted, on a bracket 36 (FIG. 2) upstanding from a base 38 of the machine frame, for pivotal movement about a shaft 40 extending widthwise of the machine. The shoe support 10 comprises a column 42 on which the last pin 12 is supported, said column being mounted for sliding heightwise movement in a post 44 supported on the shaft 40. Said column also provides a support for the toe rest arrangement 14.

For effecting pivotal movement of the shoe support 10 a piston-and-cylinder arrangement 46 is provided, a piston rod 48 of which is pivotally connected to the post 44, the cylinder being pivotally mounted, by a pin 50 in a bifurcated end of a S-shaped lever 52, itself mounted for pivotal movement about a pin 54 supported on a bracket 56 upstanding from the base 38. At its lower end, furthermore, the lever 52 is pivotally connected through two links 58, 60 on the bracket 56. The links 58, 60 are pivoted together to form a toggle arrangement at the "knee" of which is connected a piston rod 62 of a piston-and-cylinder arrangement 64 mounted on the bracket 56.

For locking the piston-and-cylinder arrangement 46 in any desired condition, locking means is also provided comprising a rod 66 mounted on the pin 50, said rod 66 having an internal bore which receives a further rod 68 pivotally connected to the post 44 of the shoe support 10; such pivotal connection may be the same as that for piston rod 48. Carried by the rod 66, furthermore, is a pneumatic clamp arrangement 70, which is effective to clamp said further rod 68 in the rod 66, and thus clamp up the piston-and-cylinder arrangement 46 and its piston rod 48. In this way, effectively a rigid link is created between the pin 50 and the post 44 of the shoe support.

Thus, in the operation of the machine, when the toggle arrangement 58, 60 is made, the lever 52 is held firm on the bracket 56, so that the piston-and-cylinder arrangement 46 is securely supported. On the other hand, when the clamp arrangement 70 is operating, breaking the toggle arrangement 58, 60 is effective to cause the shoe support to pivot about the shaft 40, such pivotal movement being through a predetermined distance.

The machine in accordance with the invention also comprises means for moving the last pin 12 and toe rest 14 heightwise to bring the heel seat region of a shoe supported thereby into engagement with the holddown 20. To this end, the column 42 extends through the post and projects downwardly from the under-side thereof, there being pivotally connected to the lower end of the column a foot 74 which engages with a wedge member 76 movable along a horizontal path, on the base 58 of the machine frame, by means of a piston-and-cylinder arrangement 78 supported by a bracket on said base.

Operation of said piston-and-cylinder arrangement is thus effective, through the wedge member 76, to raise or lower the column 42 and thus the shoe support 10.

The machine frame comprises side walls between which, at the upper end thereof, are fixed two vertical plates 82, 84 extending widthwise of the machine, and forming part of the support head of the machine frame. Centrally of the plates and extending therebetween is a bridge member 86 which carries a support block 88 having a channel 90 formed therein for receiving a support element 92 mounted for pivotal movement on a pin 94 in side wall portions of the block 88. The support element 92 also has a channel 96 in which is accommodated a necked-down portion 98 of a holddown foot 100, a plate 102 being secured across the open side of the channel thus to prevent the necked-down portion 98 falling out. At the upper end of the support element is secured a plate 104 which supports, captive therein, an adjusting screw 106, a lower end of which is threadedly received in the necked-down portion 98 of the holddown foot, rotation of the screw 106 thus serving to vary the heightwise position of the holddown foot. The support element 92, and thus the holddown foot 100, is urged about the pin 94 towards the front plate 82 by means of a spring 108 accommodated in a recess formed in the forward face of the channel 90 of the support block 88.

Figure 4A:
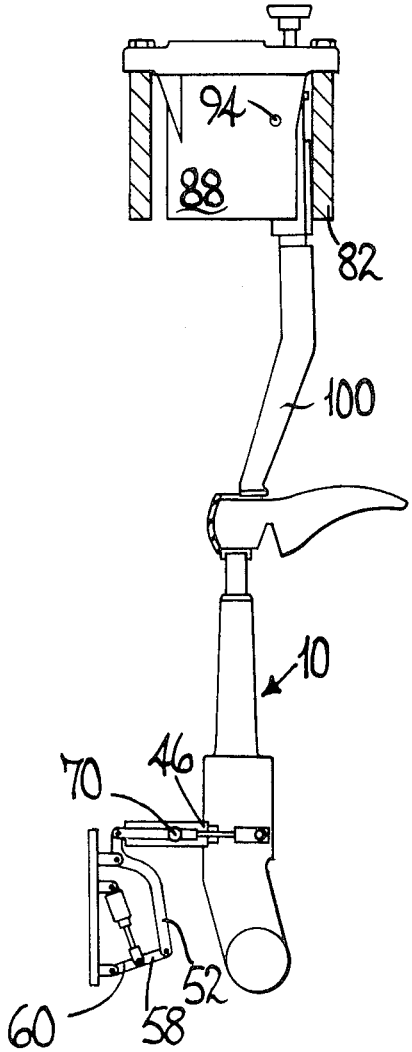
FIGS. 4*a* to 4*d* are diagrammatic representations indicating a sequence of operations in the location of a shoe lengthwise and heightwise of the machine.
Figure 4B:
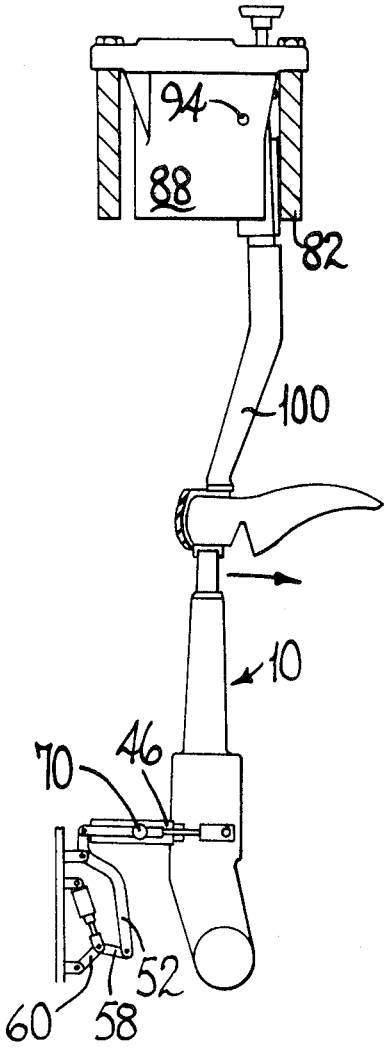
Figure 4C:
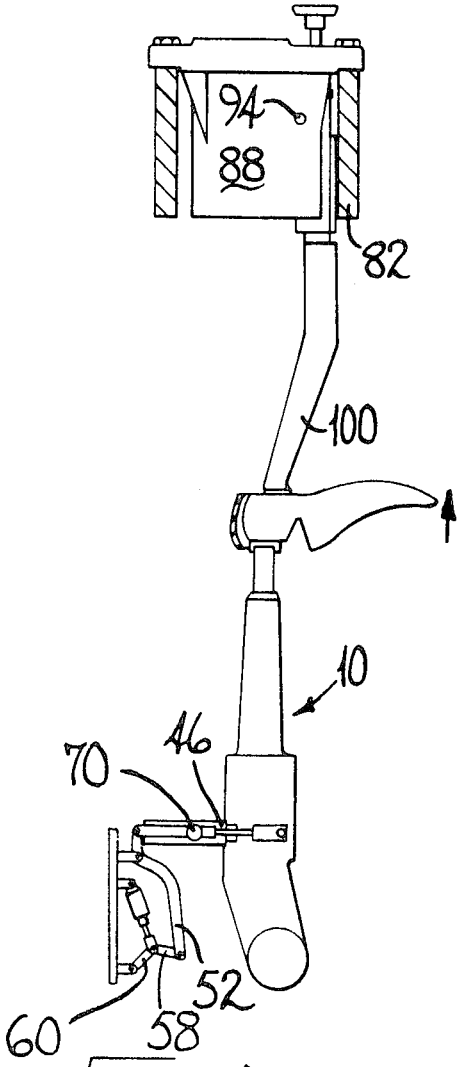
Figure 4D:
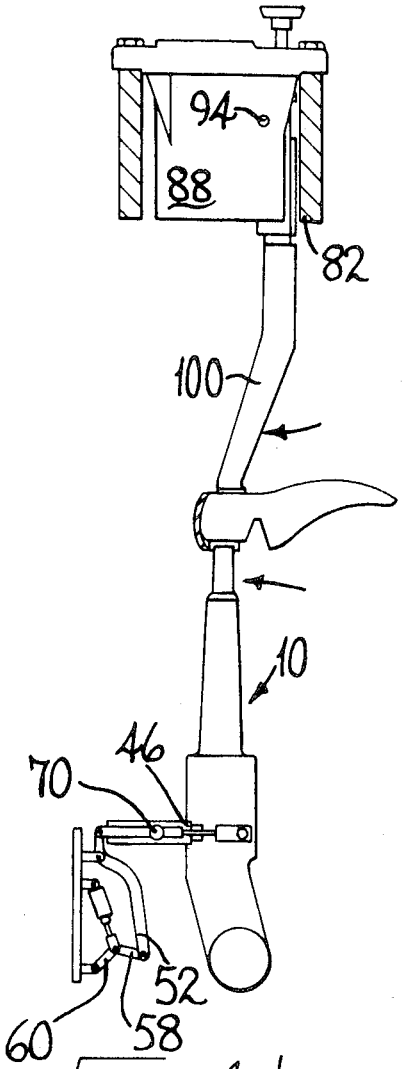

In the operation of the machine, with the holddown urged forwardly on its support 88, and with the wiper plates 18 of the heel seat lasting instrumentalities retracted and the heel band 16 in an open position (each of these three integers being mounted on the support head constituted by the machine frame, and their relative positions thus being fixed), a shoe is placed on the last pin 12 and toe rest 14 while the shoe support 10 is in a forwardly pivoted condition, whereafter, with the toggle arrangement 58, 60 made, the piston-and-cylinder arrangement 46 is operated to swing the shoe support 10 rearwardly to bring said support and the support head into an operative relationship determined by engagement of the heel end of the shoe with the heel band 16, the shoe thus being located in a lengthwise direction relative to the heel seat lasting instrumentalities and to the holddown 20 (FIG. 4*a*). At the end of a delay, controlled by a timer (not shown) which is actuated with the actuation of the piston-and-cylinder arrangement 46, the pneumatic clamp arrangement 70 is operated and the toggle arrangement 58, 60 is then broken thus effecting a forward movement of the shoe support 10 through a predetermined distance, separating the shoe support 10 from the heel band 16 to disengage the heel end of the shoe from the latter (FIG. 4*b*). While the shoe support and heel band are thus separated, the piston-and-cylinder arrangement 78 is operated whereby, through the action of the wedge member 76, the last pin and toe rest are raised to bring the heel seat region of the shoe bottom into engagement with the holddown 100 (in its forward condition), whereby to locate said heel seat region in a heightwise direction relative to the plane of the wiper plates 18 of the heel seat lasting instrumentalities (FIG. 4*c*). With the shoe thus located heightwise, the pneumatic clamp arrangement 70 is released and the piston-and-cylinder arrangement 46 is again operated to return the shoe support 10 into its lengthwise location, with the heel end of the shoe in engagement with the heel band 16 (FIG. 4*d*). During this return movement, the holddown 20 is caused to pivot about the pin 94, so that it remains in fixed engagement with the heel seat region of the shoe located thereby. With the shoe thus located heightwise and lengthwise, the shoe support 10 is locked in its position by means of a wedge member (not shown).

In using the machine in accordance with the invention, therefore, the shoe is located automatically using the heel band 16, without the need for setting up the various integers for each shoe, but also without any risk of the shoe being dislodged heightwise of its last by engagement with the heel band during its heightwise location.

We claim:

1. A machine for lasting heel seat portions of shoes comprising:

a shoe support, for supporting a shoe comprising an upper and an insole carried on a last, a support head on which are mounted a heel band, a holddown and heel seat lasting intrumentalities comprising:

two wiper plates, means for effecting relative movement of approach between the shoe support and the support head to bring them to an operative relationship determined by engagement of the heel end of a shoe supported by the shoe support with the heel band, the shoe thus being located in a lengthwise direction relative to the heel seat lasting instrumentalities and to the holddown, and means for effecting relative heightwise movement between the shoe support and the holddown, whereby to locate the heel seat region of the shoe bottom in a heightwise direction relative to the plane of the wiper plates of said instrumentalities. wherein means is provided, operable when the shoe support and support head are in their operative relationship, for effecting relative movement of separation between the shoe support and heel band through a predetermined distance to disengage the heel end of the shoe from the heel band. the relative heightwise movement between the shoe support and the holddown taking place while the heel end of the shoe and heel band are thus disengaged, whereafter return movement is caused to take place between the shoe support and the heel band to return the heel end of the shoe into engagement with the heel band.

2. A machine as recited in claim 1 wherein the means for effecting relative movement of separation between the shoe support and the heel band comprises a link arrangement the effective length of which can be varied, whereby to cause relative movement of separation to take place as aforesaid, said link arrangement being locked in a desired condition during the relative movement of approach between the shoe support and the support head.

3. A machine as recited in claim 2 wherein the means for effecting relative movement of approach between the shoe support and the support head comprises a piston-and-cylinder arrangement which is arranged to act through the link arrangement, and wherein locking means is associated with the piston-and-cylinder arrangement to lock it in the condition to which it has moved when the heel end of the shoe has been engaged by the heel band, such locking taking place prior to the effective length of the link arrangement being varied.

4. A machine as recited in claim 3 wherein said piston-and-cylinder arrangement is carried by a support linkage of which the link arrangement forms part, and variation of the effective length of the link arrangement is effective through the piston-and-cylinder arrangement to cause relative movement of separation to take place as aforesaid.

5. A machine as recited in claim 4 wherein said piston-and-cylinder arrangement is pneumatically operated, and the locking means therefor comprises a clamp arrangement which cooperates with a rod arrangement associated with the piston-and-cylinder arrangement.

6. A machine as recited in claim 2 wherein the link arrangement comprises a toggle arrangement.

7. A machine as recited in claim 1 wherein the holddown is mounted on the support head for limited movement, in a direction extending lengthwise of the shoe bottom, relative to the heel band, resilient means being provided for urging the holddown away from the heel band prior to engagement thereof with the heel seat region of the shoe as aforesaid.

8. A machine for lasting heel seat portions of shoes comprising:

a shoe support, for supporting, bottom uppermost, a shoe comprising an upper on a last with an insole on the last bottom;

heel seat lasting instrumentalities;

a heel band, which serves to determine the position of a shoe supported by the shoe support, lengthwise of its bottom, in relation to the heel seat lasting instrumentalities and to clamp the heel end of such shoe thus positioned; a holddown, which serves to determine the heightwise position of a shoe supported by the shoe support in relation to said instrumentalities, and between which and the shoe support such shoe can be clamped thus positioned; first means for moving the shoe support inwardly towards the heel band, in a direction extending generally lengthwise of the bottom of a shoe supported by the shoe support, and second means for effecting relative heightwise movement between the shoe support and the holddown;

the arrangement being such that a shoe positioned and clamped on the shoe support as aforesaid in relation to the heel seat lasting instrumentalities can then be operated upon thereby, wherein the holddown is movable relative to the heel band in a direction extending lengthwise of the bottom of a shoe supported by the shoe support, as relative movement takes place between the shoe support and heel band under the action of said first means.

9. A machine as recited in claim 8, wherein the first means is effective firstly to move the shoe support inwardly towards the heel band, to bring the heel end of a shoe supported by the shoe support into engagement with the band, then to separate them through a predetermined distance, the second means being effective, during such separation, to cause relative movement of approach to take place between the shoe support and the holddown, and thereafter again to move the shoe support inwardly towards the heel band to return the heel end of the shoe into engagement therewith, the arrangement being such that, during such return movement, the holddown, held in engagement with the shoe bottom by the action of the second means is caused to move with the shoe support relative to the heel band.

10. A machine as recited in claim 9, wherein said first means comprises a piston-and-cylinder arrangement carried by a support linkage including a link arrangement having an extended and a retracted condition, and that firstly, with said link arrangement in its extended condition, the piston-and-cylinder arrangement is actuated to move the shoe support inwardly, then, with the piston-and-cylinder arrangement locked by locking means in position, the link arrangement is moved to its retracted condition thus to separate the shoe support and the heel band, and thereafter, after operation of the second means as aforesaid, the locking means is released and the piston-and-cylinder arrangement again actuated to move the shoe support inwardly towards the heel band.

11. A machine as recited in claim 8, wherein the holddown is resiliently urged in a direction away from the heel band.

12. A machine as recited in claim 8, wherein the holddown is mounted for limited pivotal movement about an axis extending transversely of the bottom of a shoe supported by the shoe support.

* * * * *

UNITED STATES PATENT AND TRADEMARK OFFICE

CERTIFICATE OF CORRECTION

PATENT NO. : 4,485,512

DATED : December 4, 1984

INVENTOR(S) : James R. Flanders et al.

It is certified that error appears in the above-identified patent and that said Letters Patent is hereby corrected as shown below:

Column 4, lines 6 and 7, delete "co-pending patent application Ser. No. 8035768" and insert -- U. S. Pat. No. 4,462,132 --.

Column 4, lines 14 and 15, delete "co-pending patent application Ser. No. 8020133" and insert -- U. S. Pat. No. 4,322,863 --.

Signed and Sealed this

*Eighteenth* Day of *June 1985*

[SEAL]

*Attest:*

DONALD J. QUIGG

*Attesting Officer*

*Acting Commissioner of Patents and Trademarks*